US006212690B1

(12) United States Patent
Spangler

(10) Patent No.: US 6,212,690 B1
(45) Date of Patent: Apr. 10, 2001

(54) FIBER GLASS PARTICLE RESISTANT BODY GARMENT

(76) Inventor: Raymond D. Spangler, R.R. 1, Box 122, Ewing, NE (US) 68735

( * ) Notice: Subject to any disclaimer, the term of this patent is extended or adjusted under 35 U.S.C. 154(b) by 0 days.

(21) Appl. No.: 09/477,938

(22) Filed: Jan. 5, 2000

(51) Int. Cl.[7] ..... A41D 13/00
(52) U.S. Cl. ..... 2/457; 2/69; 2/903
(58) Field of Search ..... 2/456, 457, 46, 2/69, 69.5, 93–94, 173, 424, 81, 84, 85, 901, 171, 202, 206, 49, 963

(56) References Cited

U.S. PATENT DOCUMENTS

| | | | | |
|---|---|---|---|---|
| 2,144,611 | | 1/1939 | Biggs . | |
| 2,344,811 | | 3/1944 | Gill . | |
| 2,399,027 | | 4/1946 | Heribert . | |
| 2,855,603 | | 10/1958 | Zito . | |
| 3,441,063 | | 4/1969 | Press et al. . | |
| 4,677,696 | | 7/1987 | Tanaka . | |
| 4,825,473 | * | 5/1989 | Brame | 2/202 |
| 4,932,078 | | 6/1990 | Jones et al. . | |
| 5,038,414 | * | 8/1991 | Freeman | 2/409 |
| 5,119,510 | * | 6/1992 | Schilling | 2/4 |
| 5,214,797 | * | 6/1993 | Tisdale | 2/84 |
| 5,226,189 | * | 7/1993 | Blustein | 2/4 |
| 5,309,574 | * | 5/1994 | Balaban et al. | 2/202 |
| 5,341,511 | | 8/1994 | Wells . | |
| 5,535,447 | * | 7/1996 | Stevens et al. | 2/4 |
| 5,659,895 | * | 8/1997 | Ford | 2/2.11 |
| 5,713,076 | * | 2/1998 | Davis | 2/4 |
| 5,794,263 | * | 8/1998 | Carman | 2/84 |
| 5,878,442 | * | 3/1999 | Pejak | 2/409 |

* cited by examiner

*Primary Examiner*—John J. Calvert
*Assistant Examiner*—Tejash Patel
(74) *Attorney, Agent, or Firm*—Zarley, McKee, Thomte, Voorhees & Sease

(57) ABSTRACT

An upper body garment of stretchable thin material fits matingly over the workman's head including eyes, nose and mouth, yet allowing unobstructed vision for working with fiber glass construction materials from which the body is protected. The garment may be removed by pulling it off turning it inside out, capturing the fiber glass materials inside the garment. A lower body garment of the same material is provided.

1 Claim, 3 Drawing Sheets

FIBER GLASS PARTICLE RESISTANT BODY GARMENT

BACKGROUND OF THE INVENTION

The building industry including home construction involves fiber glass material being used as insulation above the ceilings and in the walls. This insulation can be either blown in place or sheet laid. The insulation material in either case produces particles injurious to a person's skin, nose, lungs and eyes. Conventionally, protection against the fiber glass particles involves the workman wearing goggles and rubber gloves on the hands. This procedure does not work satisfactorily as the particles can contact the unprotected part of the workman's body and seep behind the goggles through small openings. The rubber gloves interfere with finger gripping of tools and building materials.

What is needed is a garment that will fully protect the person's body but yet allow for complete vision and use of the hands including the fingers.

SUMMARY OF THE INVENTION

A first garment is provided that is open at one end and closed at the other and is pulled down over the head and torso with the arms and hands being inserted into sleeves that include protection for the hands and fingers. The material in the garment is thin and stretchable such that it matingly fits all surfaces of the person's body. The thinness of the material also allows the person to see through it to allow working with the fiber glass material.

Various materials may have properties allowing for sufficient stretch and be thin enough to see through while preventing fiber glass particles from penetrating through the material. One material that has been found acceptable is the stretchable nylon material used in women's pantyhose such as made by Hanes Hosewear, Osage, Iowa, or Jockey International, Inc., Kenosha, Wis. The material used in this garment varies from 75 percent nylon, 25 percent Lycra® spandex to 85 percent nylon, 15 percent Lycra® spandex (20 denier). As the material is stretched over the body including the eyes, it becomes thinner allowing for clear vision. The material lightest in color will provide for the best vision. This material will also allow air to flow freely through it, thus allowing the person to breathe freely.

The nature of this material and the way it fits over the face is such that in an extreme case tobacco products could even be used. The garment is also stretchable to allow fitting over the workman's normal work clothing. A second garment is provided for the waist down and overlaps with the upper garment at the waist, thereby protecting the entire body against skin contact with fiber glass particles.

Removal of the garments is performed in such a way that the fiber glass particles attached to the outside surface of the garments are trapped in the garment as the upper garment is pulled upwardly over the torso turning the garment inside out. The same removal step is performed with the lower garment, i.e., it is pulled downwardly turning inside out thereby trapping the fiber glass particles in the garment which is then discarded.

DETAILED DESCRIPTION OF THE INVENTION

Figure 2:
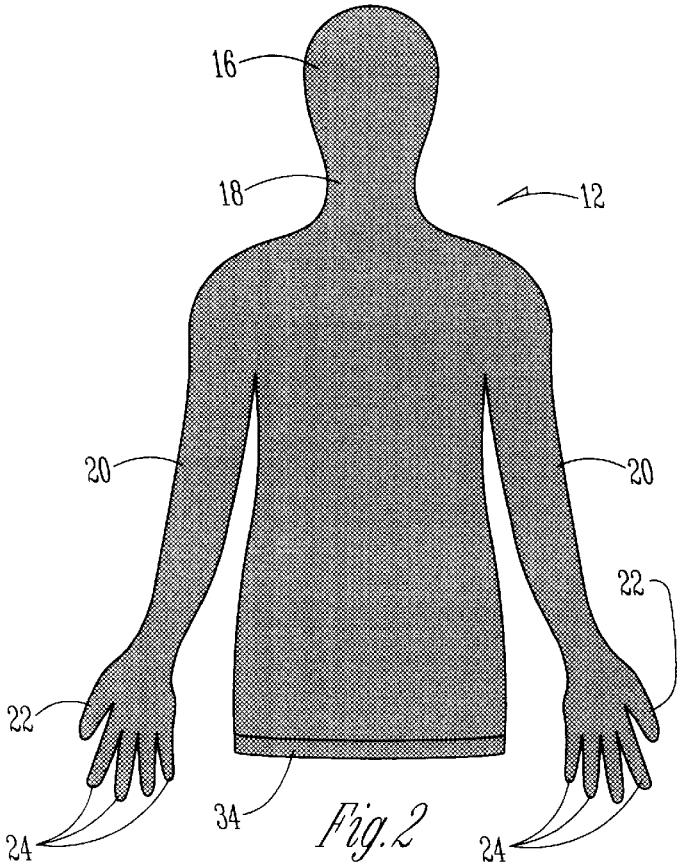
FIG. 2 is a front elevational view of a one piece upper body garment covering the head, arms, hands and torso.
Figure 3:
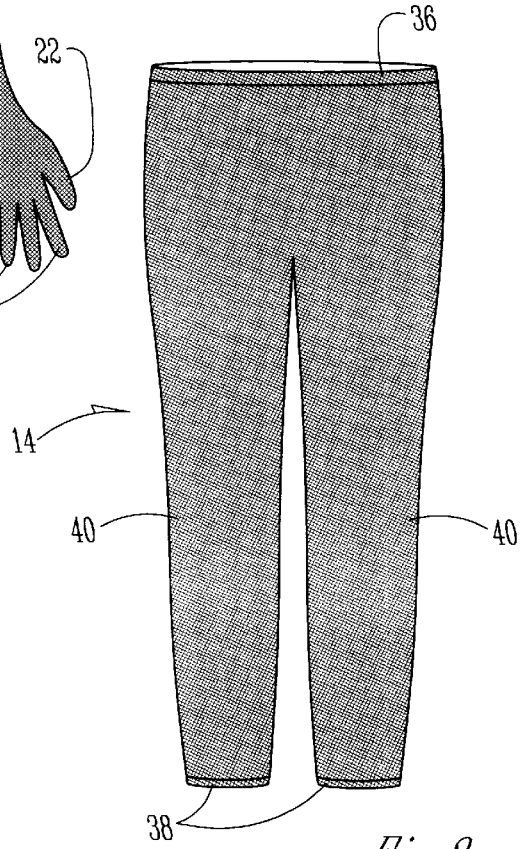
FIG. 3 is a front elevational view of a lower body garment from the waist down over the legs.
Figure 4:
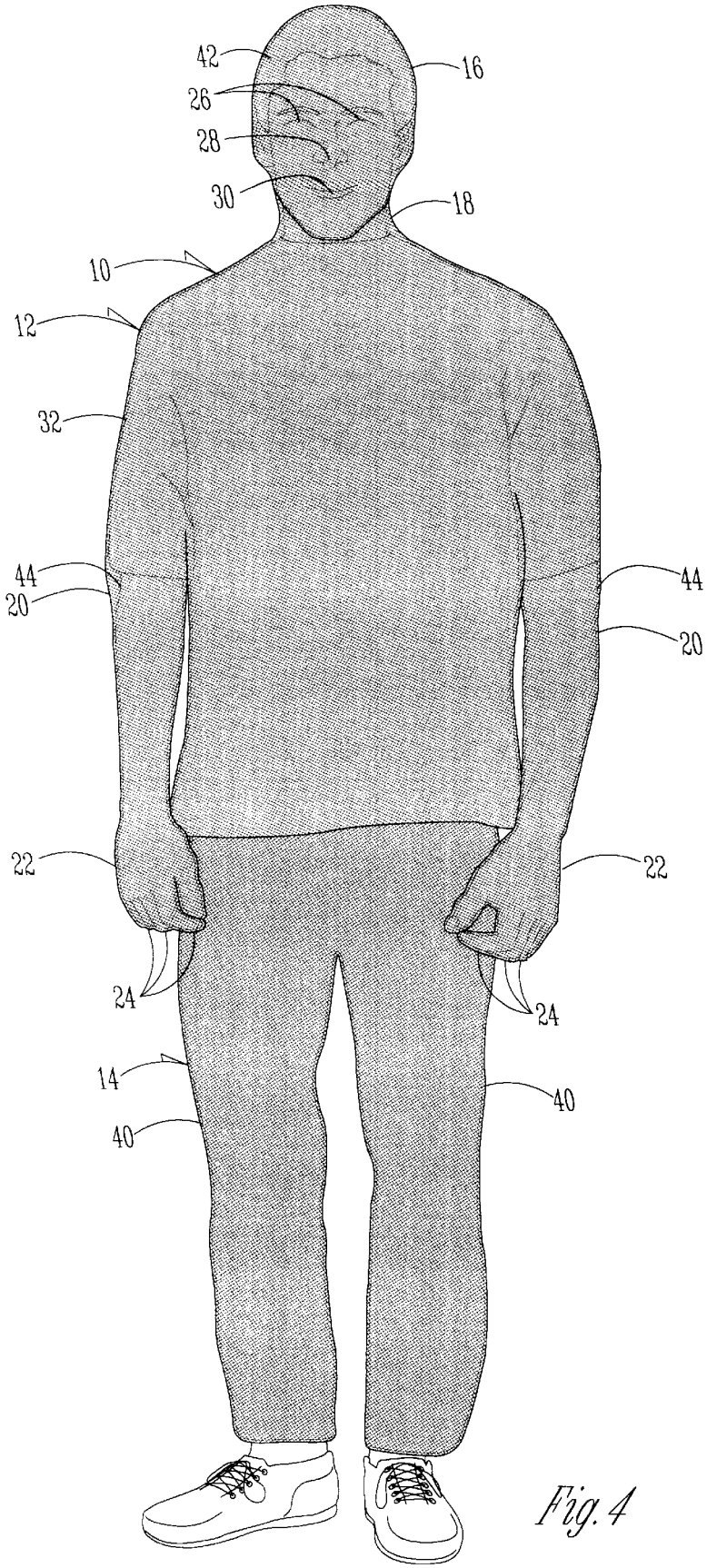
FIG. 4 is a front elevational view of a person wearing both upper and lower garments over conventional work clothing.

The body garment of this invention is referred to in FIG. 4 by the Reference 10 and includes an upper body garment 12 and a lower body garment 14 as seen in FIGS. 2 and 3.

The upper body garment 12 is one piece and matingly fits over the head 16, neck 18, arms 20, and hands 22 including fingers 24. As seen in FIG. 4, the garment material matingly fits over the eyes 26, nose 28, and mouth 30.

It is further seen in FIG. 4 that the upper garment 12 fits over the workman's work clothes including a shirt 32. An elastic band 34 at the waist seen in FIG. 2 assures a tight fit.

The lower body garment 14 also has an elastic waist 36 and elastic 38 is provided at the ankles of the legs 40. As seen in FIG. 4, the upper garment 12 overlaps the lower garment 14 at the waist.

In use, the upper garment 12 is pulled down over the head 42 with the arms 20 positioned in the sleeves 44. When the garments 12 and 14 are to be removed after working with the fiber glass construction material, the lower open end is pulled upwardly turning the garment inside out, thereby capturing the fiber glass materials inside the garment and preventing any contact with the workman's skin. The lower garment 14 is also rolled downwardly inside out, thereby protecting the workman against the fiber glass material contacting the skin.

Figure 1:
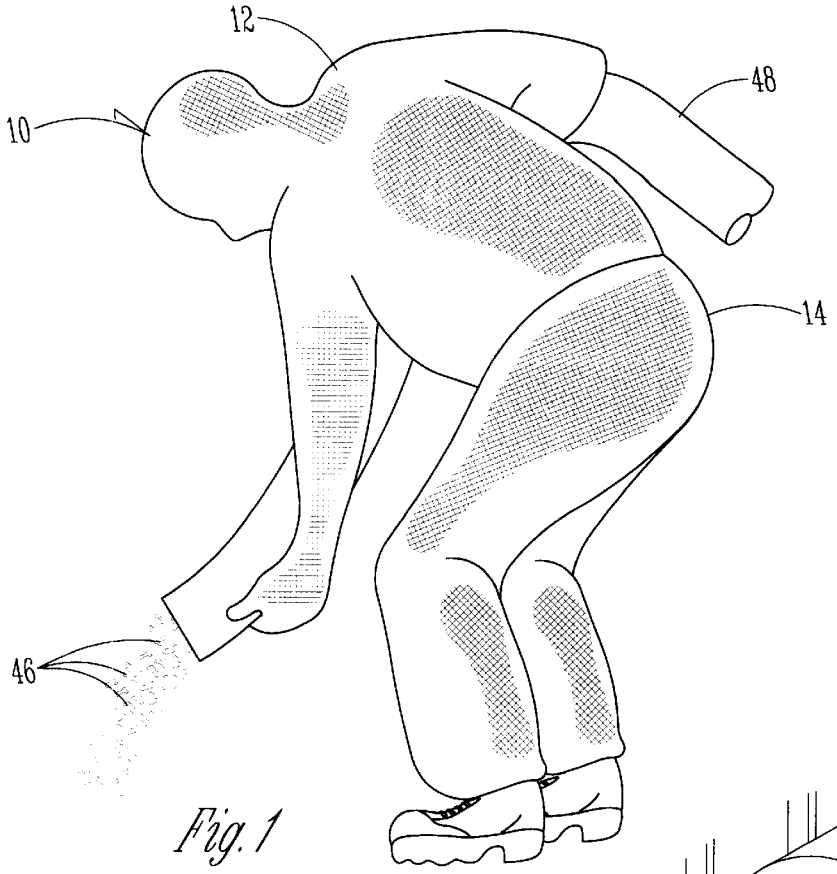
FIG. 1 is a perspective view of a person feeding loose fiber glass insulation on a construction job site.
Figure 1A:
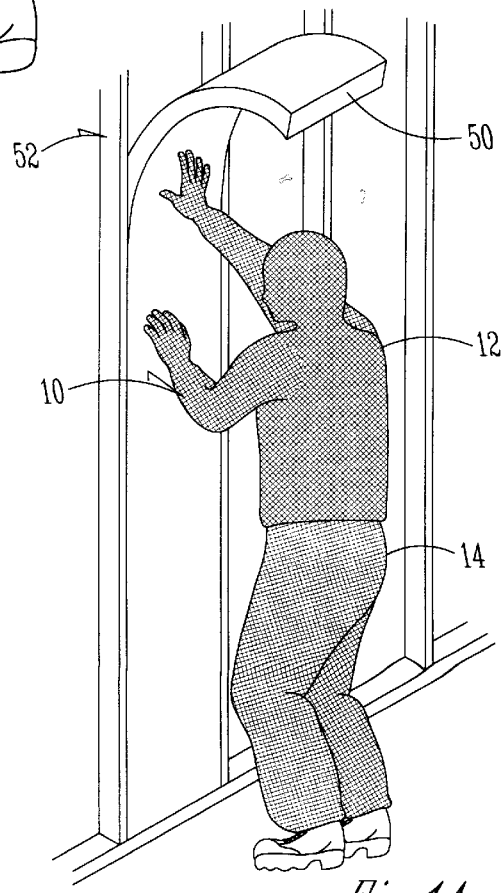
FIG. 1A is a perspective view of the workman laying fiber glass sheet material as an insulation material in a wall.

Since the workman is fully protected, he is free to lay loose fiber glass insulation 46 as seen in FIG. 1 being fed from a feeder tube 48 or apply sheet insulation material 50 in a wall 52 as seen in FIG. 1A.

What is claimed is:

1. The method of protecting a person working with fiber glass material including fiber glass particles comprising the steps of providing a first garment of thin stretchable material having opposite ends with one end being closed and the opposite other end being open, pulling the first garment open end over the head and upper body allowing the material to matingly fit around the person's head including eyes, ears and nose and extend down over the neck, shoulders, arms, hands and trunk to the waist, working with the fiber glass material using the fingers through the thin stretchable material while viewing the work area through the thin stretchable material fitted over the face, and removing the first garment by pulling the open end upwardly along the trunk and over the head while turning the first garment inside out thereby confining fiber glass particles inside the first garment protecting the person from fiber glass particles contacting the skin of the person while handling the used first garment.

* * * * *